US010934960B2

(12) United States Patent
Wu et al.

(10) Patent No.: US 10,934,960 B2
(45) Date of Patent: Mar. 2, 2021

(54) METHOD AND SYSTEM FOR ESTIMATING MASS AIRFLOW USING A MASS AIRFLOW SENSOR

(71) Applicant: GM Global Technology Operations LLC, Detroit, MI (US)

(72) Inventors: Zhijian J. Wu, Rochester Hills, MI (US); Zhiping S. Liu, Canton, MI (US); Ping Ge, Northville Township, MI (US); Martino A. Casetti, Clarkston, MI (US); Gregory P. Matthews, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 53 days.

(21) Appl. No.: 16/179,030

(22) Filed: Nov. 2, 2018

(65) Prior Publication Data

US 2020/0141346 A1 May 7, 2020

(51) Int. Cl.

*F02D 41/18* (2006.01)
*F02D 41/00* (2006.01)
*F02D 41/24* (2006.01)

(52) U.S. Cl.

CPC ..... *F02D 41/18* (2013.01); *F02D 41/0002* (2013.01); *F02D 41/2474* (2013.01); *F02D 2200/0402* (2013.01)

(58) Field of Classification Search

CPC ..... F02D 41/14; F02D 41/18; F02D 41/2474; F02D 41/00; F02D 41/0002; G06F 7/70; G06F 19/00

USPC ..... 701/101–105

See application file for complete search history.

(56) References Cited

U.S. PATENT DOCUMENTS

| | | | |
|---|---|---|---|
| 3,818,877 A | 6/1974 | Barrera et al. | |
| 4,986,243 A | 1/1991 | Weissler, II et al. | |
| 5,014,550 A | 5/1991 | Gee et al. | |
| 6,370,935 B1 | 4/2002 | He et al. | |
| 6,574,956 B1 * | 6/2003 | Moraal | F01N 9/002 123/568.18 |

(Continued)

OTHER PUBLICATIONS

Svoboda, Mark H., Comparison of Air Meter Interface Strategies for Engine Management Systems, Electronic Engin Controls 2000: Modeling, Neural networks, OBD, and Sensors (SP-1501), SAE 2000 World Congress, Detroit MI, Mar. 6-9, 2000, SAE International, Warrendale, PA, USA.

*Primary Examiner* — John Kwon
*Assistant Examiner* — Johnny H Hoang

(57) ABSTRACT

A method and system for estimating air mass per cylinder of an internal combustion engine is provided. An output signal from a MAF sensor is digitally processed to provide an estimate air mass per cylinder (APC). The system includes the MAF sensor; a data acquisition unit configured to receive an output signal from the MAF sensor and produce a sampled signal having a sampling rate greater than one sample per firing event; a multiple band pass (MBP) filter configured to remove signal components caused by airflow pulsations and oscillations through the MAF sensor; an envelope detector configured to detect the lower and upper envelopes of the MBP filtered signal; a MAF estimator configured to estimate a mass airflow based on the detected lower and upper envelopes; a signal decimator; a low pass filter; and a APC converter to converted the low pass filtered signal into an estimated APC.

9 Claims, 5 Drawing Sheets

(56) References Cited

U.S. PATENT DOCUMENTS

| | | | | |
|---|---|---|---|---|
| 7,614,384 | B2 * | 11/2009 | Livshiz | F02D 11/105 123/399 |
| 7,698,049 | B2 * | 4/2010 | Whitney | F02D 31/002 701/103 |
| 2002/0133286 | A1 * | 9/2002 | Kolmanovsky | F02D 41/18 701/104 |
| 2003/0088356 | A1 | 5/2003 | Kabat et al. | |
| 2010/0012072 | A1 * | 1/2010 | Leone | F02D 41/10 123/192.1 |
| 2014/0278012 | A1 * | 9/2014 | Xiao | F02D 41/0002 701/108 |

* cited by examiner

METHOD AND SYSTEM FOR ESTIMATING MASS AIRFLOW USING A MASS AIRFLOW SENSOR

The present disclosure relates to engine control systems, and more particularly to a method and system for estimating a mass airflow to an internal combustion engine by using a mass airflow sensor.

Modern internal combustion engines use a mass airflow (MAF) sensor to provide a real-time measurement of mass airflow into the engine, so that the engine control module (ECM) can schedule the appropriate amount of fuel for the current engine speed and load conditions. Common MAF sensors used in motor vehicles work on the principal of a hot-wire anemometer, also known as a sensor wire, that uses constant current or constant temperature principals. A heated element is maintained at a controlled temperature rise above ambient temperature. This heated element is exposed to the air flowing into the engine so that the airflow draws heat away from the heated element. The amount of power that is require to maintain the temperature of the heated element, and hence the voltage across the heated element, varies with the flow rate. The MAF sensor can scale the voltage across the heated element to provide a frequency or voltage output that varies with flow.

MAF sensors working on the principal of a hot-wire anemometer provides good accuracy in measuring steady direction in a single direction, also known as unidirectional airflow, within an induction system to the engine. However, in modern combustion engines with variable valve timing, forced induction, advance emission control system, cylinder deactivation, and other engine improvements for improved fuel savings and emission controls, the actual airflow in the induction system might not be unidirectional. The airflow through the induction system may experience pulsations and oscillations, and not pure unidirectional flow, across the MAF sensors due to the above mentioned engine advancements and improvements. The pulsations and oscillations of airflow may affect the accuracy of the MAF sensors, thus affecting fuel economy and emission controls.

Thus, while current systems and methods of estimating mass airflow to an internal combustion engine achieve their intended purpose, there is a need for an improved method and system for estimating mass airflow in modern engines to account for pulsations and oscillations of airflow, non-unidirectional airflow, within the induction system to the internal combustion engine.

SUMMARY

According to several aspects, a method for estimating air mass per cylinder of an internal combustion engine is provided. The method includes receiving a MAF sensor output signal from a mass airflow (MAF) sensor; sampling the MAF sensor output signal to produce a sampled MAF signal; passing the sampled MAF signal through a multiple band pass (MBP) filter; determining an upper envelope and a lower envelope of the MBP filtered sampled MAF signal; generating an estimated MAF signal as a function of at least one of the upper envelope and the lower envelope; passing the estimated MAF signal through a decimator to produce a decimated MAF signal; passing the decimated MAF signal through a low pass filter; and calculating a mass air per cylinder from the low pass filtered decimated MAF signal.

In an additional aspect of the present disclosure, the mass air per cylinder is calculated using the formula: APC=MAF*120000/(Ncyl*RPM). Where APC is air per cylinder in milligram (mg)/cylinder; MAF is the mass airflow grams per second (g/s); Ncyl is the number of cylinder; and RPM is revolution per minute of the internal combustion engine.

In another aspect of the present disclosure, the step of sampling the MAF signal includes sampling the MAF signal at sampling rate of greater than one sample per cylinder firing event.

In another aspect of the present disclosure, the sample rate is 3 sample per cylinder firing event.

In another aspect of the present disclosure, the step of passing the sampled MAF signal through the multiple band pass (MBP) filter to produce the MBP filtered MAF signal, includes filtering the sampled MAF signal through the MBP filter to remove predetermined undesired signal components.

In another aspect of the present disclosure, the method further includes generating the estimated MAF signal as a function of the lower envelope.

In another aspect of the present disclosure, the method further includes generating a digital pulse signal by the mass airflow (MAF) sensor, wherein the digital pulse signal is signal voltage correlating with a rate of mass airflow through the MAF sensor; converting the digital pulse signal to a MAF frequency signal; and outputting the MAF frequency signal as the MAF sensor output signal.

In another aspect of the present disclosure, the step of passing the sampled MAF signal through the MBP filter removes signal components caused by at least one of airflow pulsations and oscillations through the MAF sensor.

In another aspect of the present disclosure, the step of passing the sampled MAF signal through the MBP filter removes odd number harmonic frequency components.

In another aspect of the present disclosure, method further includes the step of communicating the calculated mass air per cylinder to an engine control module.

According to several aspects, a digital signal processing based air mass estimation system (DSP air mass estimation system) for an internal combustion engine is provided. The DSP air mass estimation system includes a mass airflow sensor (MAF) sensor configured to generate a MAF Sensor Output Signal correlating with a real-time measurement of a mass airflow through the MAF sensor; a data acquisition unit configured to receive the MAF Sensor Output Signal from the MAF sensor and produce a Sampled MAF Signal having a sampling rate greater than one sample per firing event of the internal combustion engine; a multiple band pass (MBP) filter configured filter the Sampled MAF Signal and output a MBP Filtered Signal; an envelope detector configured to detect the lower and upper envelopes of the MBP Filtered Signal and output an Envelope Output Signal; and an MAF estimator configured estimate a mass airflow based on the Envelope Output Signal and output an Estimated MAF Signal.

In an additional aspect of the present disclosure, the system further includes a signal decimator configured to decimate the Estimated MAF Signal; and a low pass filter configured to further process the Decimated MAF Signal to remove undesired noise or interferences and output a Low Pass Filtered Signal.

In another aspect of the present disclosure, the system further includes an air per cylinder (APC) convertor configured to calculate an air mass per cylinder based on the Low Pass Filtered Signal and output an Estimated APC Signal.

In another aspect of the present disclosure, the APC convertor is further configured to estimate the air per cylinder using the formula: APC=MAF*120000/(Ncyl*RPM).

Where APC is air per cylinder in milligram (mg)/cylinder; MAF is the mass airflow grams per second (g/s); Ncyl is the number of cylinder; and RPM is revolution per minute of the internal combustion engine.

In another aspect of the present disclosure, the data acquisition is further configured to produce a Sampled MAF Signal having a sampling rate of 3 samples per firing event of the internal combustion engine.

In another aspect of the present disclosure, the MBP filter is further configured to filter out signal components caused by at least one of airflow pulsations and oscillations through the MAF sensor.

According to several aspects, a motor vehicle having a DSP module is provided. The motor vehicle includes an internal combustion engine having at least one cylinder; a mass airflow (MAF) sensor configured to generate a MAF sensor output signal correlating with a real-time measurement of a mass airflow into the internal combustion engine; and the digital signal processing (DSP) module configured to digitally process the MAF sensor output signal from the MAF to estimate an air mass per cylinder (APC). The DSP module includes a data acquisition unit configured to receive the MAF Sensor Output Signal from the MAF sensor and produce a Sampled MAF Signal having a sampling rate of 3 samples per firing event of the internal combustion engine; and a multiple band pass (MBP) filter configured filter the Sampled MAF Signal to remove signal components caused by at least one of airflow pulsations and oscillations through the MAF sensor, and output a MBP Filtered Signal.

In an additional aspect of the present disclosure, the DSP module further includes an envelope detector configured to detect the lower and upper envelopes of the MBP Filtered Signal and output an Envelope Output Signal; an MAF estimator configured to estimate a mass airflow based on the Envelope Output Signal and output an Estimated MAF Signal; a signal decimator configured to decimate the Estimated MAF Signal; and a low pass filter configured to further process the Decimated MAF Signal to remove undesired noise or interference and output a Low Pass Filtered Signal.

In another aspect of the present disclosure, the DSP module further includes an air per cylinder (APC) convertor configured to calculate an air mass per cylinder based on Low Pass Filtered Signal and output an Estimated APC Signal.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

A mass airflow (MAF) sensor is a central component to measure airflow into an intake manifold for modern engine controls. With the measured mass airflow, the air mass into the engine cylinder, usually called mass air per cylinder (APC), can be calculated. Based on the calculated APC, the desired amount of fuel delivered to each cylinder for efficient combustion can be calculated. The existing methods used to estimate APC using MAF sensors are adequate with internal combustion engines that have minimal pulsation or oscillation of airflow across the MAF sensors. However, in modern combustion engines having exaggerated pulsation or oscillation of airflow across the MAF sensors due to engine improvements, such as variable valve timing, forced induction, cylinder deactivation, advance emission controls, etc., it was discovered that the current methods may over estimate APC by 10 to 15 percent. The over estimation of airflow may result in inaccurate fuel air ratio required for efficient combustion, thereby resulting in increased fuel usage and/or emissions emitted to the environment.

The present disclosure provides a novel method and system for estimating APC of an internal combustion engine, specifically to an internal combustion engine having a reciprocating piston. In the disclosed embodiment, the output signals from a MAF sensor is digitally processed to provide an estimated APC. It is contemplated that the present disclosure can be implemented for MAF sensors in a variety of engine configurations, such as diesel or gasoline fueled internal combustion engines, and reciprocating or rotary type engines. It is further contemplated that the MAF sensors are not limited to hot-wire anemometer type MAF sensors, and may include hot-film MAF sensors and other known MAF sensors.

Figure 1:
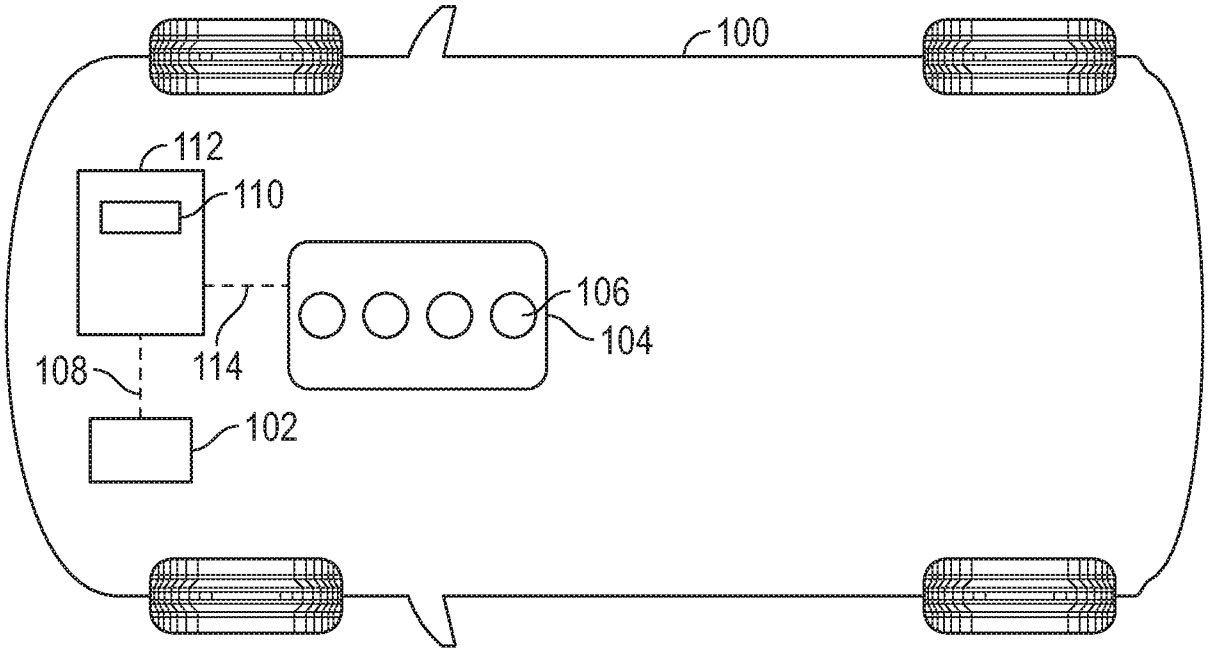
FIG. 1 is a schematic top view of a vehicle having a system for estimating airflow using a mass airflow sensor, according to an exemplary embodiment.

FIG. 1 shows a motor vehicle 100 having a MAF sensor 102 configured to measure mass airflow to an internal combustion engine 104 having at least one combustion chamber 106, or cylinder 106. The MAF sensor 102 may be that of a hot-wire anemometer-type MAF sensor disposed within an induction system (not shown) directing air to the combustion engine 104. Thus, the MAF sensor 102 includes associated circuitry that outputs a signal, also referred to as MAF Sensor Output Signal 108, in relation to the heat transfer through the sensor wire which is within the path of the airflow. The MAF Sensor Output Signal 108 is processed by a digital signal processing (DSP) module 110 containing a system that utilizes a method for estimating air mass per cylinder of the internal combustion engine 104. The DSP module 110 is shown disposed within an engine control module (ECM) 112. It should be appreciated that the DSP module 110 may be a separate module from the ECM 112 and spaced from the ECM 112 without departing from the scope of the invention.

The DSP module 110 electronically communicates with the ECM 112 by sending a digital processed output signal to the ECM 112. The ECM 112 may include a microprocessor based controller that monitors the digital processed output signal from the DSP module 110 as well as other engine parameters and calculates the fuel delivery command along with other engine control signals and feeds the signals to the fuel injectors and other engine operating elements. The ECM 112 may be adapted by programming one or more programmable read-only memory (PROM) chips in the ECM 112 to cooperate with the DSP module 110.

Figure 2:
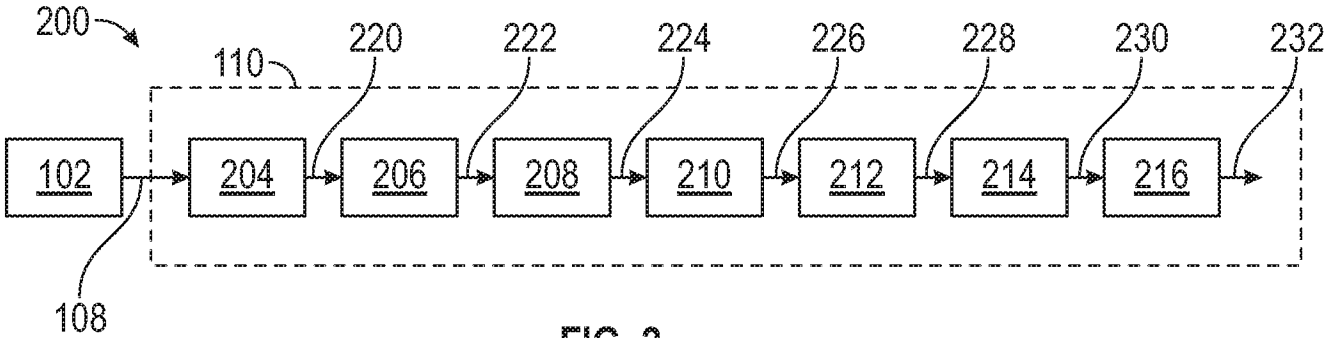
FIG. 2 is a block diagram of a digital signal processing (DSP) based air mass estimation system, according to an exemplary embodiment.

Referring to FIG. 2, is a block diagram of a DSP based air mass estimation system, generally indicated by reference number 200, and referred to herein as a DSP system 200. The DSP system 200 estimates air mass per cylinder (APC) for a reciprocating combustion engine based on an air mass estimation process. The system includes the MAF sensor 102 of FIG. 1, a data acquisition unit 204, a multiple band pass (MBP) filter 206, an envelope detector 208, a MAF estimator 210, a signal decimator 212, a low pass filter 214, and a MAF signal to APC converter 216. The data acquisition unit 204, MBP filter 206, envelope detector 208, MAF estimator 210, signal decimator 212, low pass filter 214, and MAF signal to APC converter 216 may be housed within the DSP module 110, or may distributed between the MAF sensor 102 and ECM 112, or may distributed amongst other electronic systems within the vehicle 100. For example, the data acquisition unit 204 may be an integrated circuit within the circuitry of the MAF sensor 102; the MAF to APC converter 216 may be an integrated circuit or microprocessor within the ECM 112; and the MBP filter 206, signal decimator 212, and low pass filter 214 may be dedicated hardware based filters and/or reconfigurable software defined filters.

The MAF sensor 102 is configured to generate the MAF Sensor Output Signal 108 that correlates with the real-time measurement of mass airflow into the internal combustion engine 104. The data acquisition unit 204 is configured to receive the MAF Sensor Output Signal 108 from the MAF sensor 102 and produce a Sampled MAF Signal 220 having a sampling rate that is higher than one sample per cylinder firing event in the engine crank angle domain. The MBP filter 206 is configured to remove undesired signal components and retains the desired signal components from the Sampled MAF Signal 220, and output a MBP Filtered Signal 222. The envelope detector 208 is configured to detect the lower and upper envelopes of the MBP Filtered Signal 222 and provides an Envelope Output Signal 224 having upper and lower envelopes. The MAF estimator 210 is configured to output an Estimated MAF Signal 226 based on the lower and upper envelopes of the Envelope Output Signal 224. The signal decimator 212 is configured to decimate the Estimated MAF Signal 226 to reduce computational load and output a Decimated MAF Signal 228. The low pass filter 214 is configured to further process the Decimated MAF Signal 228 to remove undesired noise or interference and output a Low Pass Filtered Signal 230. The MAF to APC convertor 216 is configured to calculate the air mass that enters into the engine cylinders based on the digitally processed MAF signal in the Low Pass Filtered Signal 230 and output an Estimated APC Signal 232 to the ECM 112.

Figure 3:
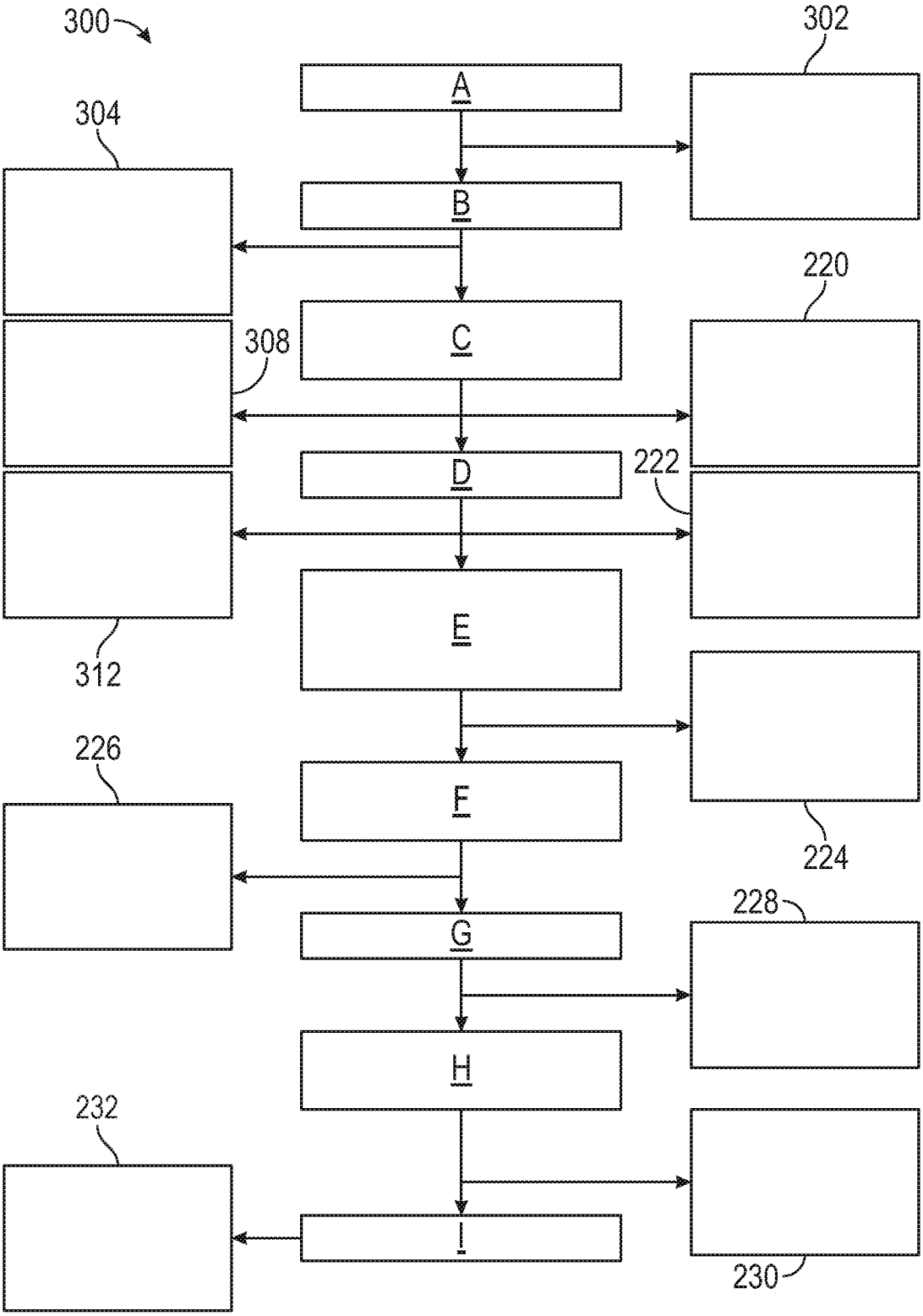
FIG. 3 is a flow diagram for a method for estimating air mass per cylinder of an internal combustion engine using the system of FIG. 2, according to an exemplary embodiment.
Figure 4:
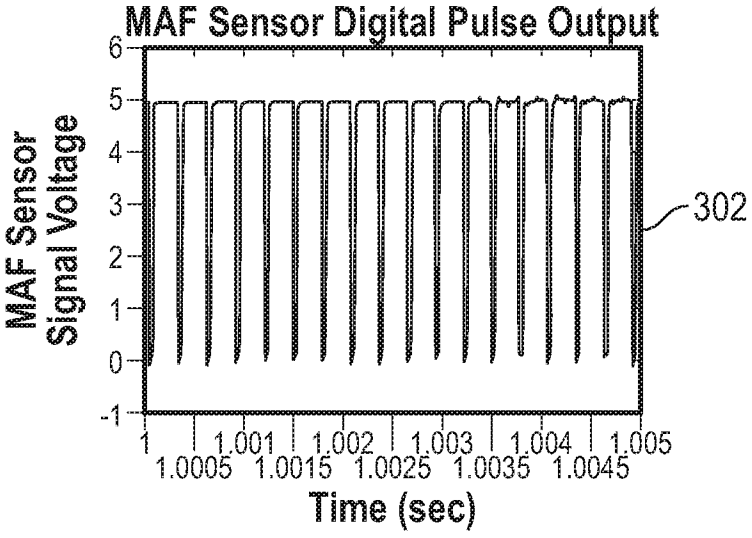
FIG. 4 shows a digital pulse output signal of a mass airflow sensor.

FIG. 3 shows a flow diagram for a method using digital signal processing (DSP) for estimating air mass per cylinder of an internal combustion engine 104, generally indicated by reference 300, also referred to as a DSP method 300. The DSP method 300 is implemented by the DSP System 200 of FIG. 2 for the vehicle 100 of FIG. 1. The DSP Method 300 starts in Block A, with the internal combustion engine 104 operating, the MAF sensor 102 generates a MAF sensor signal voltage that correlates with a rate of mass airflow through the MAF sensor 102 to the internal combustion engine 104. The MAF sensor signal voltage output may be a digital pulse signal or an analog signal that is then converted to a digital pulse signal by an analog to digital converter (ADC). The digital pulse signal generated by the MAF sensor 102 is referred to herein as a Sensor Digital Pulse Output 302 as shown in FIG. 4.

Figure 5:
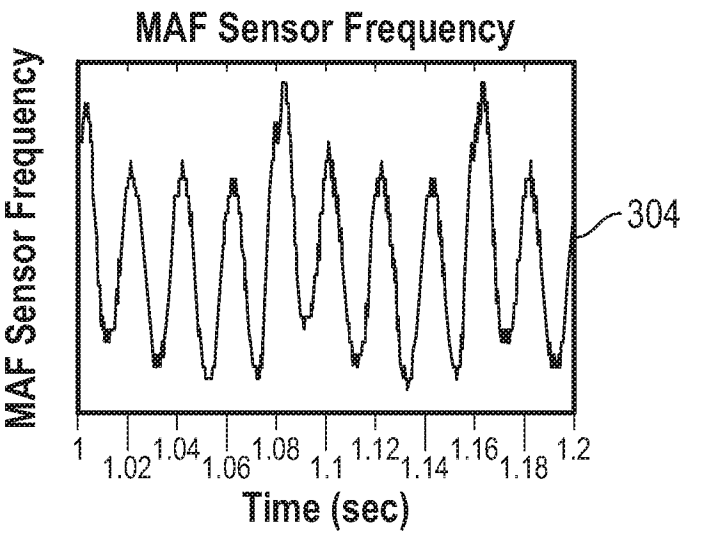
FIG. 5 shows a frequency output signal converted from the digital pulse output signal of FIG. 4.
Figure 6:
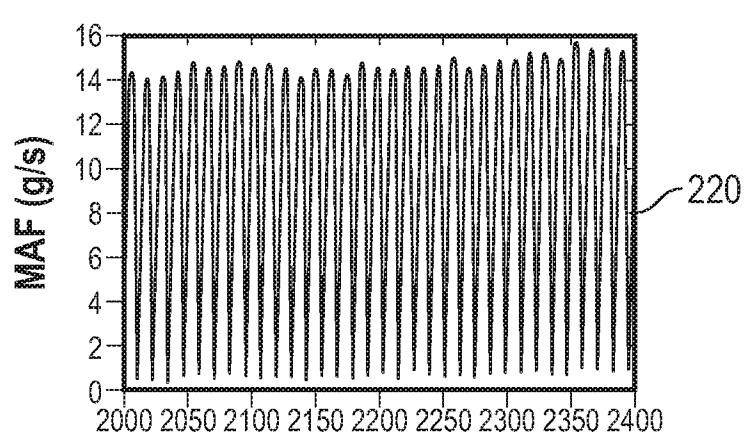
FIG. 6 shows a MAF sensor output signal converted from the frequency output signal from FIG. 5.
Figure 7:
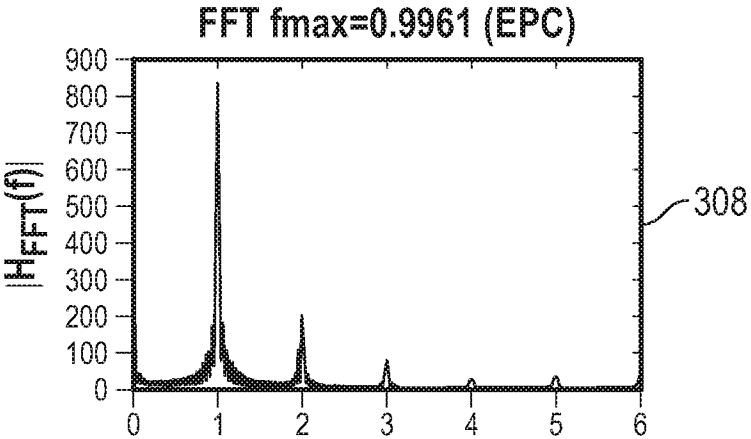
FIG. 7 shows a Fast Fourier Transform over the crankshaft angular frequency domain of the MAF sensor output signal of FIG. 6, where the crankshaft angular frequency is displayed in the unit of the events per cycle (EPC)

In Block B, the MAF sensor Digital Pulse Output 302 is converted to a MAF Frequency Signal 304, which is the MAF Sensor output Signal 108 as shown in FIG. 2. FIG. 5 shows a plot of an exemplary MAF Frequency Signal 304. In Block C, the MAF Frequency Signal 304 is sampled at a rate of 3 samples per firing event. A firing event, also known as an ignition event, is the event where the air/fuel mixture in a combustion chamber, such as a cylinder, of an internal combustion engine is ignited either by a spark plug in a gasoline engine or by compression in a diesel engine. For example, in a four cylinder, four stroke, internal combustion engine, two firing events happens in two separate cylinders for every 360 degree rotation (one revolution) of the crank. All four of the cylinders will be fired once in a 720 degree rotation of the crankshaft. The MAF Frequency Filter 304 is sampled by the data acquisition Unit 204 to produce the Sampled MAF Signal 220, which is a high frequency modulate signal containing the information of the rate of mass airflow through the MAF sensor 102. FIG. 6 shows an exemplary Sampled MAF Signal 220. FIG. 7 is a Fast Fourier Transform (FFT) 308 showing the odd and even harmonics of the Sampled MAF Signal 220.

Figure 9:
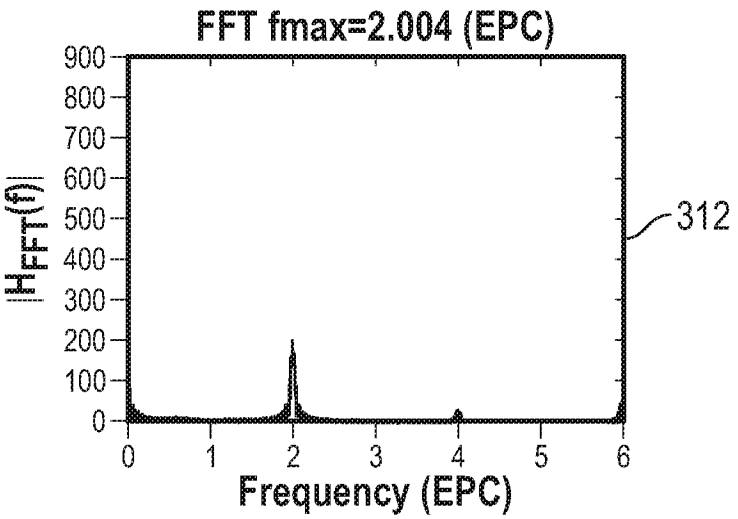
FIG. 9 shows a Fast Fourier Transform over the crankshaft angular domain of the multiple band filtered MAF sensor output signal of FIG. 8.
Figure 8:
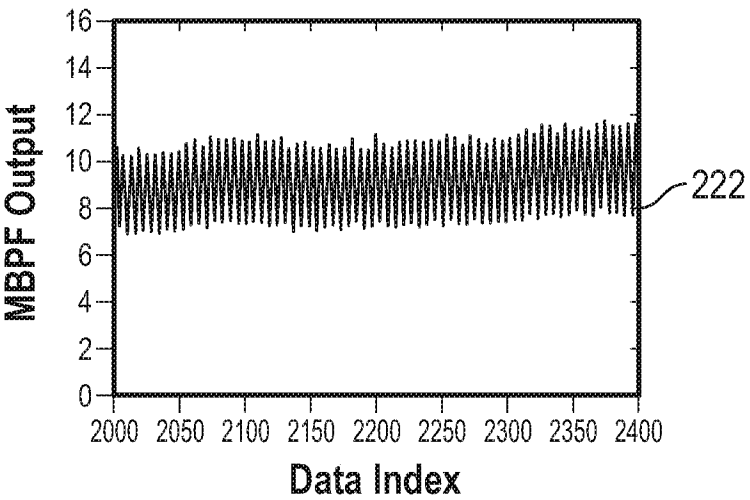
FIG. 8 shows a multiple-band pass filtered MAF sensor output signal of FIG. 6.

In Block D, the Sampled MAF Signal 220 is passed through the MBP filter 206 to remove undesired signal components, such as the odd number harmonic frequency components that are caused by airflow pulsations and oscillations, and retains the desired signal components, such as the direct current (DC) component and even number harmonic frequency components. The undesirable components of the Sampled MAF Signal 220 may be determined by comparing the Sampled MAF Signal 220 with that of a calibrated MAF signal (not shown) generated by a Reference Engine. A Reference Engine is one where the engine, the induction pathway of the engine, and associated components are configured such that any pulsations and oscillations of airflow through the MAF sensor of the Reference Engine is reduced or eliminated. The reduction or elimination of the pulsations and oscillations of airflow through the MAF sensor of the Reference Engine is verified by laboratory airflow measuring equipment in connection with the Reference Engine. The MBP filtered Sampled MAF Signal 220 is referred to as a MBP Filtered Signal 222 as shown in FIG. 8. FIG. 9 is a Fast Fourier Transform (FFT) 312 of the MBP Filtered Signal 222, which shows the odd number harmonics filtered out of the Sampled MAF Signal 220.

Figure 11:
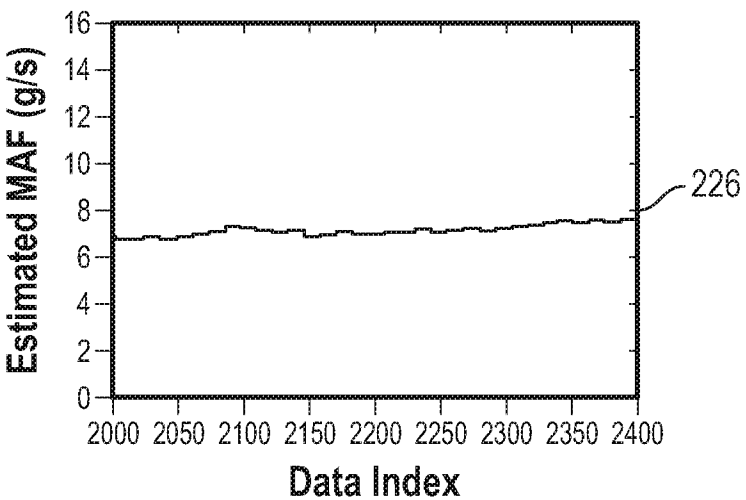
FIG. 11 shows an estimated MAF signal from the upper and lower envelopes of FIG. 10.
Figure 10:
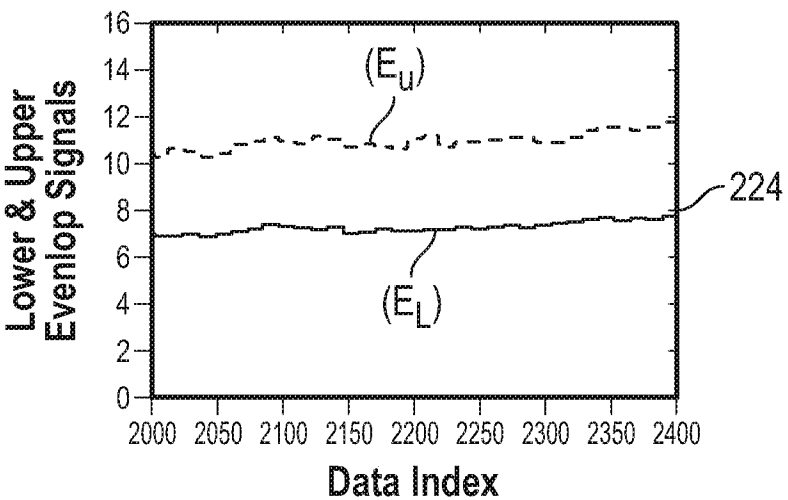
FIG. 10 shows a detected upper and lower envelopes of the multiple band filtered MAF sensor output signal of FIG. 8.

In Block E, the envelope detector 208 determines the upper and lower envelopes of the MBP Filtered Signal 222 based on every engine revolution or every engine cycle, and produces an Envelope Output Signal 224. The envelopes of the oscillating MBP Filtered Signal 310 are smooth curves outlining the extremes of the MBP Filtered Signal 222, in which the sine wave varying between the upper and a lower envelopes. The Envelope Output Signals 224 are shown in FIG. 10. In Block F, an estimated mass airflow is determined from the upper and lower envelopes, that is, the Estimated MAF signal 226 can be expressed a function of the upper and lower envelopes, f(EU, EL), where EU, EL are the lower and upper envelopes. It was discovered that in some applications, the lower envelope (EL) correlates most accurately with the mass airflow measured laboratory instruments. FIG. 11 shows an exemplary of the Estimated MAF Signal 226.

Figure 12:
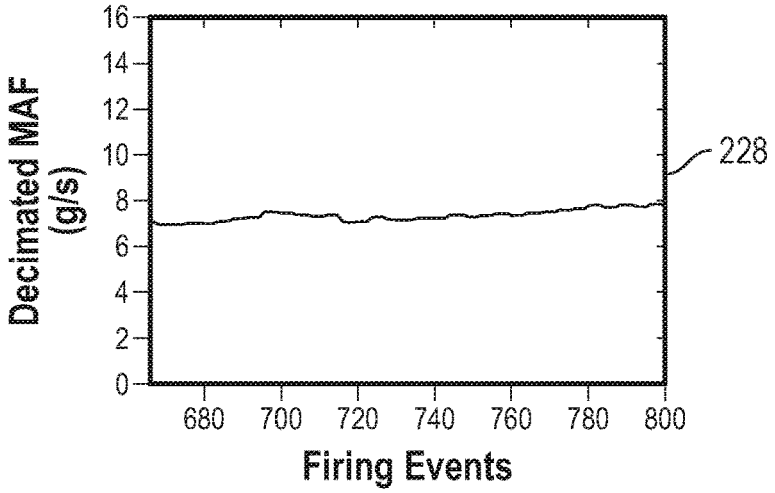
FIG. 12 shows a decimated MAF signal from FIG. 11.
Figure 13:
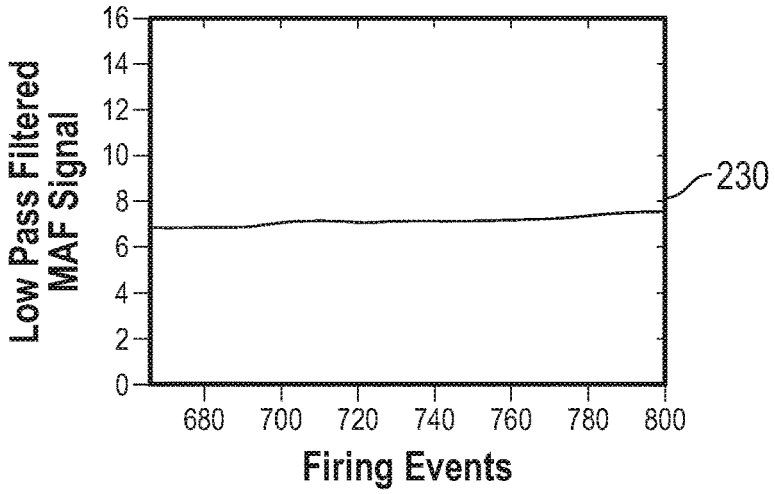
FIG. 13 shows a low pass filtered decimated lower envelope of FIG. 12.
Figure 14:
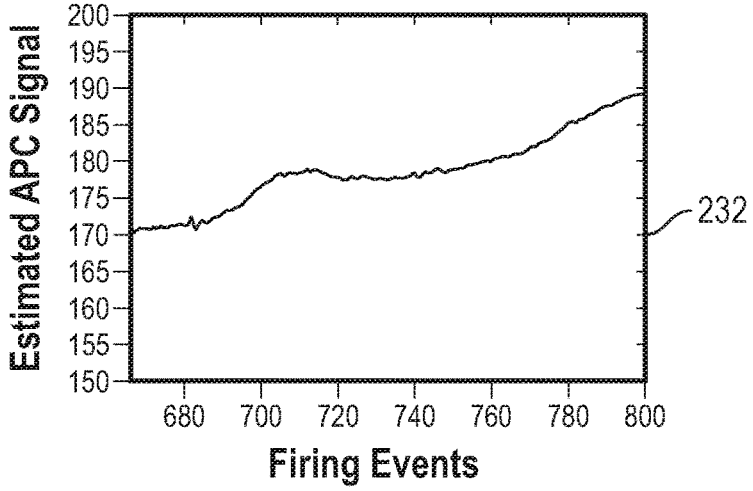
FIG. 14 shows the estimated air mass per cylinder (APC) based on the low pass filtered decimated MAF signal of FIG. 13.

In Block G, the signal decimator decimates the high data rate mass airflow signal to a low data rate mass airflow signal, that is, one sample data per firing event, to reduce computational load. The low rate decimated signal is referred to as a Decimated MAF Signal 228. FIG. 12 shows an exemplary Decimated MAF Signal 228. In Block H, the low pass filter 214 is applied to the Decimated MAF Signal 228 to produce the Low Pass Filter Signal 230. In Block I, the MAF to APC converter 216 calculates the mass air per cylinder (APC) in milligram (mg) from the mass airflow information contained in the Low Pass Filter Signal 230 and using the formula: APC=MAF*120000/(Ncyl*RPM). Where MAF is the mass airflow grams per second (g/s), Ncyl is the number of cylinders, RPM is the engine speed in revolution per minute. The MAF to APC converter 216 then sends an Estimated APC signal 232 to the ECM 112.

The disclosed method for estimating air mass per cylinder has been tested in dynamometer using a modern engine configuration (Test Engine) having exaggerated the pulsation or oscillation of airflow across the MAF sensor 102 and a reference engine configuration (Reference Engine) having minimal to no pulsation or oscillation of airflow across the MAF sensor. The airflow to the combustion chamber of the Test Engine is measured by calibrated laboratory equipment to determine and accurate airflow to calculate a true APC. The APC are estimated at predetermined engine RPMs and are compared with the true APC as measured by laboratory equipment to give a relative error and the APC estimation preformation is evaluated.

Table 1 below presents the relative errors of the APC as estimated using the inventive DSP method disclosed and the existing method for the Test Engine. The inventive method disclosed herein achieves much more accurate estimation for the Test Engine as compared to the prior art method. Table 1 shows the estimation performance comparison for the new APC estimation method and the existing APC estimation method for an engine with enhanced emission controls. The disclosed method achieves more than 73% reduction of the relative estimation error.

TABLE 1

| RPM | Existing Method Relative Error (%) | New DSP Method Relative Error (%) | Reduction of Relative Error (%) |
|---|---|---|---|
| 1300 | 15.2 | 3.77 | 75 |
| 1400 | 12.7 | 2.87 | 77 |
| 1500 | 11.4 | 2.53 | 78 |
| 1600 | 10.3 | 2.74 | 73 |
| 1700 | 10.1 | 2.57 | 75 |

Table 2 below presents the relative errors of the APC as estimated using the inventive DSP method disclosed herein and the existing prior art method for the Reference Engine. The disclosed method not only significantly improves the APC estimation performance for the Test Engine having exaggerated pulsation of airflow across the MAF sensor 102, but also for the Reference Engine having minimal to no pulsation of airflow across the MAF sensor 102. The disclosed method achieves more than 33% reduction of the relative estimation error.

TABLE 2

| RPM | Existing Method Relative Error (%) | New DSP Method Relative Error (%) | Reduction of Relative Error (%) |
|---|---|---|---|
| 1300 | 3.14 | 1.96 | 38 |
| 1400 | 3.28 | 1.99 | 39 |
| 1500 | 3.95 | 2.53 | 36 |
| 1700 | 4.29 | 2.87 | 33 |

The method and system for estimating air mass per cylinder for a reciprocating combustion provides a benefit of improved accuracy of APC estimates thus improving fuel economy and reduced emission level. Another benefit is the APC estimation performance is significantly improved for an engine having exaggerated pulsating and oscillating airflows across the MAF sensor 102 as well as with engines having minimal pulsating and oscillating airflows across the MAF sensor 102. Yet another benefit is that no or minimal calibration is required thus eliminating or reducing time consumed for calibration work. Still yet another benefit is that the method and system is simple and have very low computational load. A further benefit is that the method be implemented current production-ready MAF sensors and ECMs.

While the invention has been described in connection with one or more embodiments, it should be understood that the invention is not limited to those embodiments. On the contrary, the invention covers all alternatives, modifications and equivalents as may be included within the spirit and scope of the appended claims.

What is claimed is:

1. A method for estimating air mass per cylinder of an internal combustion engine, comprising:

receiving a MAF sensor output signal from a mass airflow (MAF) sensor;

sampling the MAF sensor output signal to produce a sampled MAF signal;

passing the sampled MAF signal through a multiple band pass (MBP) filter to produce a MBP filtered MAF signal;

determining an upper envelope and a lower envelope of the MBP filtered MAF signal;

generating an estimated MAF signal as a function of at least one of the upper envelope and the lower envelope;

passing the estimated MAF signal through a decimator to produce a decimated MAF signal;

passing the decimated MAF signal through a low pass filter to produce a low pass filtered decimated MAF signal;

calculating a mass air per cylinder (APC) from the low pass filtered decimated MAF signal;

communicating the calculated APC to an engine control module (ECM) by outputting an APC signal to the ECM, and controlling a delivery of fuel, by the ECM, to a cylinder of the internal combustion engine based on the APC signal.

2. The method of claim 1, wherein the mass air per cylinder is calculated using:

APC=MAF*120000/(Ncyl*RPM);

wherein APC is air per cylinder in milligrams (mg)/cylinder;

wherein MAF is the mass airflow grams per second (g/s);

wherein Ncyl is the number of cylinder; and wherein RPM is revolution per minute of the internal combustion engine.

3. The method of claim 2, wherein the step of sampling the MAF sensor output signal includes sampling the MAF sensor output signal at a sampling rate of greater than one sample per cylinder firing event.

4. The method of claim 3, wherein the sampling rate is 3 samples per cylinder firing event.

5. The method of claim 2, wherein the step of passing the sampled MAF signal through the MBP filter to produce the MBP filtered MAF signal, includes filtering the sampled MAF signal through the MBP filter to remove predetermined undesired signal components.

6. The method of claim 2, further includes generating the estimated MAF signal as a function of the lower envelope.

7. The method of claim 1, further comprising:

generating a digital pulse signal by the mass airflow (MAF) sensor, wherein the digital pulse signal is a signal voltage correlating with a rate of mass airflow through the MAF sensor;

converting the digital pulse signal to a MAF frequency signal; and outputting the MAF frequency signal as the MAF sensor output signal.

8. The method of claim 1, wherein the step of passing the sampled MAF signal through the MBP filter, includes removing signal components caused by at least one of an airflow pulsation and an airflow oscillation through the MAF sensor.

9. The method of claim 1, wherein the step of passing the sampled MAF signal through the MBP filter removes odd number harmonic frequency components.

* * * * *